United States Patent [19]

Haidet

[11] Patent Number: 4,834,438

[45] Date of Patent: May 30, 1989

[54] DEVICE FOR LIFTING AND INVERTING CYLINDRICAL CONTAINERS

[76] Inventor: Donald A. Haidet, 903 W. 5th St., Ontario, Calif. 91762

[21] Appl. No.: 243,058

[22] Filed: Sep. 9, 1988

[51] Int. Cl.[4] ..... B65D 25/28

[52] U.S. Cl. ..... 294/31.2; 294/151; 294/165; 294/169

[58] Field of Search ..... 294/31.2, 137, 142, 294/165, 169, 166, 152; 248/154; 16/114 R

[56] References Cited

U.S. PATENT DOCUMENTS

| | | | |
|---|---|---|---|
| 2,399,786 | 5/1946 | Caton . | |
| 3,050,329 | 8/1962 | Miller | 294/31.2 |
| 3,337,102 | 8/1967 | Shannon . | |
| 3,427,064 | 2/1969 | Hanschar | 294/137 |
| 4,045,069 | 8/1977 | Fife | 294/31.2 |
| 4,116,374 | 9/1978 | Garello . | |
| 4,310,110 | 1/1982 | Dexter . | |
| 4,325,503 | 4/1982 | Swinney . | |
| 4,487,443 | 12/1984 | Adamick . | |
| 4,570,835 | 2/1986 | Criqui et al. . | |

*Primary Examiner*—James B. Marbert
*Attorney, Agent, or Firm*—Sheldon & Mak

[57] ABSTRACT

A lifting device is provided for lifting and inverting home-delivered bottled water containers. The device comprises a semi-cylindrical frame and two handles. The handles are disposed on opposite sides of the frame and extend outwardly from the frame such that the longitudinal axes of the handles are substantially coincident with a straight line which, when the device is in use, extends through the center of gravity of the bottle.

5 Claims, 3 Drawing Sheets

DEVICE FOR LIFTING AND INVERTING CYLINDRICAL CONTAINERS

BACKGROUND

The field of the present invention is methods and devices for lifting heavy objects. More particularly, the present invention relates to devices and methods for lifting and inverting heavy cylindrical containers.

The use of home-delivered bottled water has become increasingly popular over the last 15 years. Increased concern over the existence of pollutants in many residential tap water supplies has prompted an increase in the number of people who rely on home-delivered bottled water for drinking purposes. Also, physicians are increasingly prescribing bottled water for health purposes, especially for the ill and the elderly.

A significant problem exists with respect to the use of home-delivered bottled water. In most cases, the bottled water is delivered in cylindrical vessels weighing about 40 pounds. Lifting such 40 pound vessels is awkward even for a large man and is virtually impossible for some women, the ill and the elderly. Because of the cylindrical nature of the water bottles, it is awkward and difficult for any two individuals to lift and invert the large water vessels onto the water dispenser. This fact has precluded many individuals who want and, in some cases need, bottled water from being able to use bottled water in their homes.

Devices have been developed to assist in the lifting and carrying of heavy cylindrical objects. However, must such devices are not convenient for both lifting and inverting the cylindrical object. Lifting devices generally have one or more of the disadvantages of being difficult to attach to the container, being awkward to invert the cylindrical container, being expensive to manufacture, and being difficult to store during periods of non-use. Furthermore, during the process of lifting and inverting a cylindrical container, the securing means in many devices are inadequate.

U.S. Pat. No. 4,116,374 discloses a cylinder-carrying strap with opposed handles attached to the strap and adapted to be secured against a cylindrical container. This device has the disadvantage of not being convenient for inverting the container. Another disadvantage of this device is that it requires the user to make sure that the strap is very tightly secured to the container to prevent the container from coming loose from the device during lifting and inverting.

There is therefore a need for a lifting device which can be used to lift and invert a heavy cylindrical container.

There is also a need for such a lifting device which is simple, easy and inexpensive to use in the home of the ill and the elderly and by office personnel.

SUMMARY

The present invention satisfies these needs.

The present invention is a device for lifting and inverting cylindrical containers comprising a rigid support means which forms a substantially semi-cylindrical cavity of slightly larger diameter than the diameter of the cylindrical container, a means for securing the container to the rigid support means, and horizontal handles with longitudinal axes the extensions of which pass through substantially the center of gravity of the container.

The means for securing the container to the rigid support means can be a belt means including two straps with first ends attached to a corner of the rigid support means and belt attachment means attached to second ends of the straps.

The present invention provides a device for lifting and inverting cylindrical containers which (1) is convenient for securing the container inside the device, (2) provides support when the container is lifted and inverted, even when the container is not tightly secured to the device, (3) is convenient for rotating the container while inverting it, (4) is inexpensive to manufacture, and (5) is convenient to store during non-use.

The device of the present invention is especially adapted to the lifting, carrying, and inverting water bottles for installation in a water dispenser.

The device is easily secured to the water bottle by tipping the container from an upright position on its circular bottom edge and slipping the rigid support means underneath the container so that the cavity formed by the device is occupied by the bottle. This activity can be easily performed by one person. The means for securing the bottle to the device is then activated.

The bottle can be easily lifted by two persons using the device of the invention, one on each horizontal handle. After lifting, the device can be easily rotated along an axis substantially through the bottle's center of gravity and perpendicular to the bottle's longitudinal axis so as to gradually pour the contents of the container into the water dispenser.

A further advantage of the device of the present invention is that it provides support for the cylindrical container, even when the means for securing the container inside the rigid support means is not tightly secured. The device of the present invention substantially reduces the risk of the container becoming unsecured because the rigid support means provides support for the container when it is lifted and when it is inverted for emptying.

A still further advantage of a device of the present invention is that it is inexpensive and simple to manufacture. The present invention can be made with a small number of parts and inexpensive materials. No complex manufacturing processes are required.

A still further advantage of the present invention is that it is easy to store when it is not being used. The device is sufficiently small that it takes up a minimal amount of space. Furthermore, the device can be made of relatively lightweight materials so it can be conveniently hung on a wall or in a closet.

DRAWINGS

These and other features, aspects, and advantages of the present invention will become better understood with reference to the following description, appended claims, and accompanying drawings where:

DESCRIPTION

Figure 1:
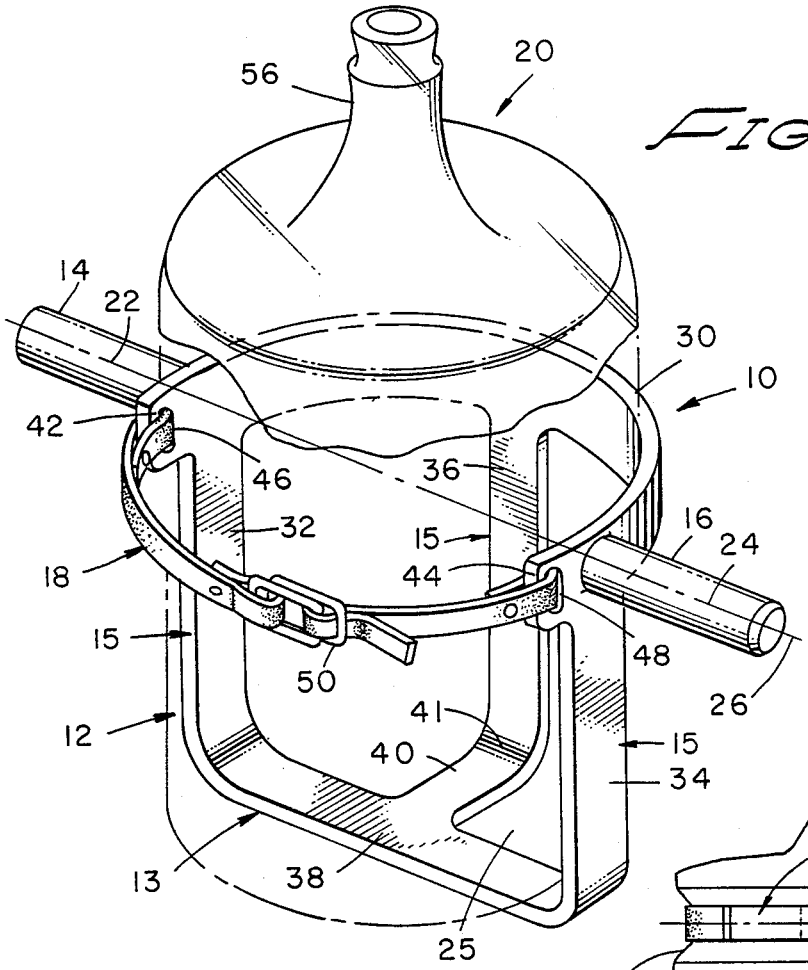
FIG. 1 is a perspective view of a lifting device having features of the present invention, illustrated with a cutaway water bottle secured inside the device.

Referring to FIG. 1, the lifting device 10 is illustrated with a rigid support frame 12 comprised of a horizontal support frame base 13 and upwardly extending sides 15, horizontal cylindrical handles 14 and 16, and securing means 18. A water bottle 20 having a horizontal base 21 and upwardly extending sides 23 is secured within the rigid support frame 12 by the securing means 18.

Figure 2:
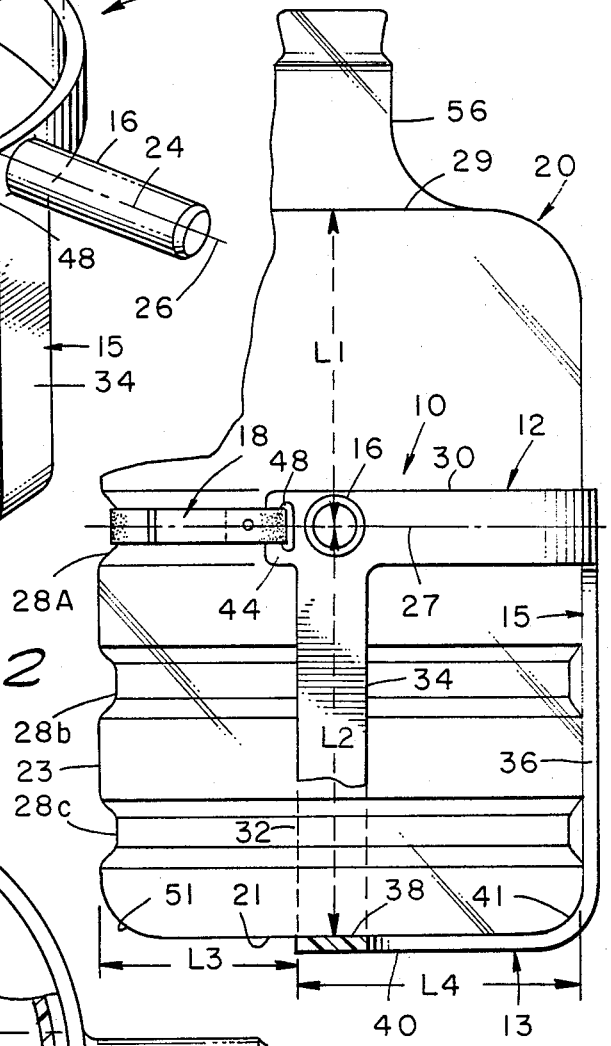
FIG. 2 is a side view of the device and water bottle of FIG. 1.
Figure 3:
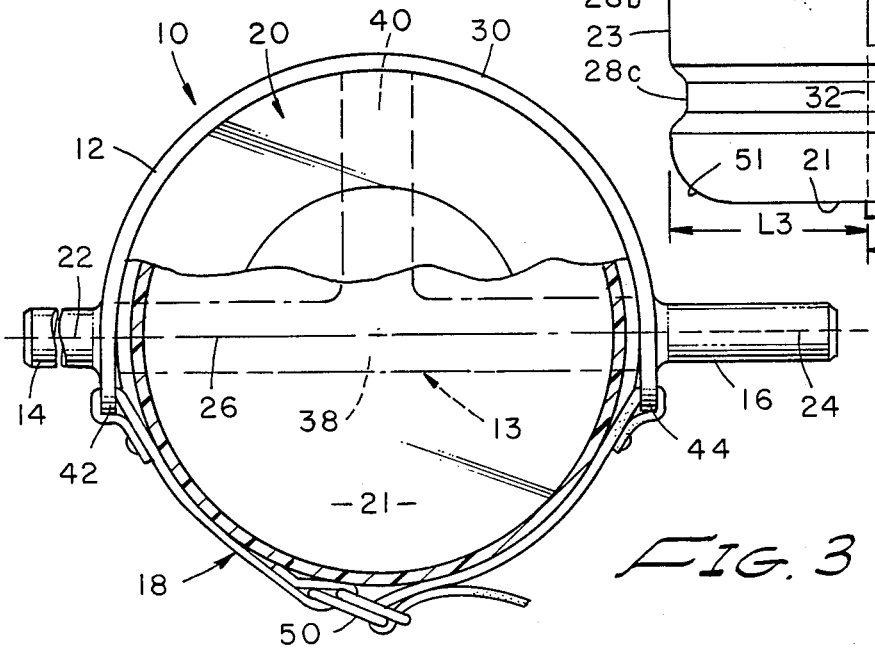
FIG. 3 is a top view of the device of FIGS. 1 and 2 with the water bottle in partial cross-section.

As can be readily seen from FIGS. 1, 2 and 3, the rigid support frame 12 forms a semi-cylindrical cavity whose shape conforms to the shape of the outside surface of the water bottle 20 and defines a vertical opening 25 adapted to accept the bottle 20. This cavity has a diameter which is slightly greater than the base portion 21 (see FIG. 2) of the bottle 20. As can best be seen from FIG. 2, the rigid support means 12 is adapted to extend slightly more than half way beyond the horizontal geometric center of the bottle 20. That is, linear distance L4, which is the distance between the inside surface of the back vertical bar 36 (defined below) and the leading edge of the transverse bottom bar 38 (defined below) is slightly greater than the linear distance L3, which is the distance between the leading edge of the transverse bottom bar 38 and the side of the wall 23 of the bottle 20 which is farthest away from the back vertical bar 36. This makes the seating of the bottle 20 more stable during lifting and inverting.

As can be seen best from FIGS. 2 and 3, the longitudinal axes 22 and 24 of the horizontal handles 14 and 16 are co-linear with a straight line 26 which passes through approximately the center of gravity of the water bottle 20. The center of gravity of the water bottle 20 is disposed within a horizontal plane 27 which is disposed a distant L2 above the horizontal support frame base 13 and extends through the bottle 20 (when the bottle 20 is disposed in place on the lifting device 10) in such a way that equal weights of liquid are disposed above and below the horizontal plane 27. The straight line 26 is substantially parallel to the plane 27 and is between about 0.2 L2 and about 1.2 L2 above the support frame base 13. Preferably, for ease of pivoting the bottle 20 about the straight line 26, the straight line 26 is disposed a distance between about 0.9 L2 and about 1.1 L2 above the support frame base 13.

In the particular embodiment of the invention shown in the drawings, the straight line 26 does not pass through the exact vertical geometric center of the cylindrical portion of the bottle 20. As illustrated in FIG. 2, the linear distance L1 which is the distance between the plane 27 and the top of the liquid 29 is less than the linear distance L2. The reason for this asymmetry is that the bottle grooves 28A, 28B, and 28C cause less water to be contained in the lower portion of the bottle 20 than the upper portion when the bottle is full. Therefore, the center of gravity of the full water bottle is slightly above the vertical geometric center.

The longitudinal axes 22 and 24 of the horizontal handles 14 and 16 need not be in a line through the exact center of gravity of the bottle. If the longitudinal axes are in a line within, for example, about two inches of the center of gravity of the bottle, the device will work effectively during lifting and inverting. However, in order to be most effective for rotating the bottle when it is being inverted, the handles are substantially at the center of gravity in the preferred embodiment.

Depending on the shape and contents of the bottle 20 being lifted, the center of gravity of the bottle 20 may change as the bottle 20 is inverted and emptied. Therefore, the longitudinal axes 22 and 24 of the handles 14 and 16 may be better placed slightly away from the center of gravity of the bottle 20 when it is sitting upright, so as to better approximate the changing center of gravity of the bottle 20 as it is emptied.

The longitudinal axis of the bottle 20, which is generally along the lines in FIG. 2 defining distances L1 and L2, is at substantially a right angle to the longitudinal axes 22 and 24 of the handles 14 and 16. If the axes 22 and 24 are at an angle substantially different from ninety degrees, the rotation of the bottle 20 when it is being inverted is awkward. In modified embodiments of the invention, the handles 14 and 16 can be adapted to be adjustable in the vertical direction parallel to the longitudinal axis of the bottle. This adaptation would allow the handles 14 and 16 to be adjustable for bottles with centers of gravity at different heights.

The rigid support frame 12 comprises a semi-circular bar 30, first and second opposed vertical bars 32 and 23, a back vertical bar 36, a transverse bottom bar 38, and a radial bottom bar 40. The semi-circular bar 30 is formed substantially in a semi-circle to conform to the bottle 20. The opposed vertical bars 32 and 34 form opposing vertical edges on the rigid support frame 12. The points of connection between the first and second vertical bars 32 and 34, and the transverse vertical bar 38, and between the radial bottom bar 40 and the back vertical bar 36 are formed in an arcuate manner so as to conform to the bottle 20. This is best illustrated in FIG. 2 by the point 41 at the juncture between the back vertical bar 36 and the radial bottom bar 40.

The securing means 18 is attached to the upper corners 42 and 44 of the rigid support frame 12 at the ends of the semicircular bar 30. The means for attachment in this embodiment includes attachment slots 46 and 48, but other attachment means can be used.

The rigid support frame 12 can be made of any suitable material. Hard plastics and light metals are preferable because of their light weight. Plastic materials suitable in the invention are polycarbonate, polypropylene, or other hard plastic. However, polycarbonate is the preferred material because of its strength and light weight. The thickness of the rigid support frame in the preferred embodiment can range from about 3/16 to about 5/16 inches.

The preferred method of manufacturing the rigid support frame is to mold it in one piece as in the embodiment of the Figures, by any conventional means. However, the various parts of the rigid support frame 12 can be riveted, attached with inset screws, or joined by any other conventional means used in the manufacturing arts.

The horizontal handles 14 and 16 can be made of wood, plastic, or metal. They can be attached to the rigid support frame 12 with screws, rivets, or can be molded in one piece with the frame 12. Finally, the handles 14 and 16 can be either hollow or solid.

The securing means 18 comprises two straps which can be mode of leather, plastics, weaved fabric, or other suitable material. The securing means 18 can be a slip buckle 50, as illustrated in the Figures, or other conventional attachment means, such as another kind of buckle or a Velcro ® attachment mechanism.

Turning now to FIGS. 4A, 4B, 5 and 6, the operation of the lifting device 10 will be explained. One person secures the bottle 20 to the lifting device 10 by tipping the bottle on its bottom edge 51, sliding the transverse bottom bar 38 and bottom radial bar 40 underneath the bottle 20, and tightening the securing means 18 against the bottle 20.

Figure 4A:
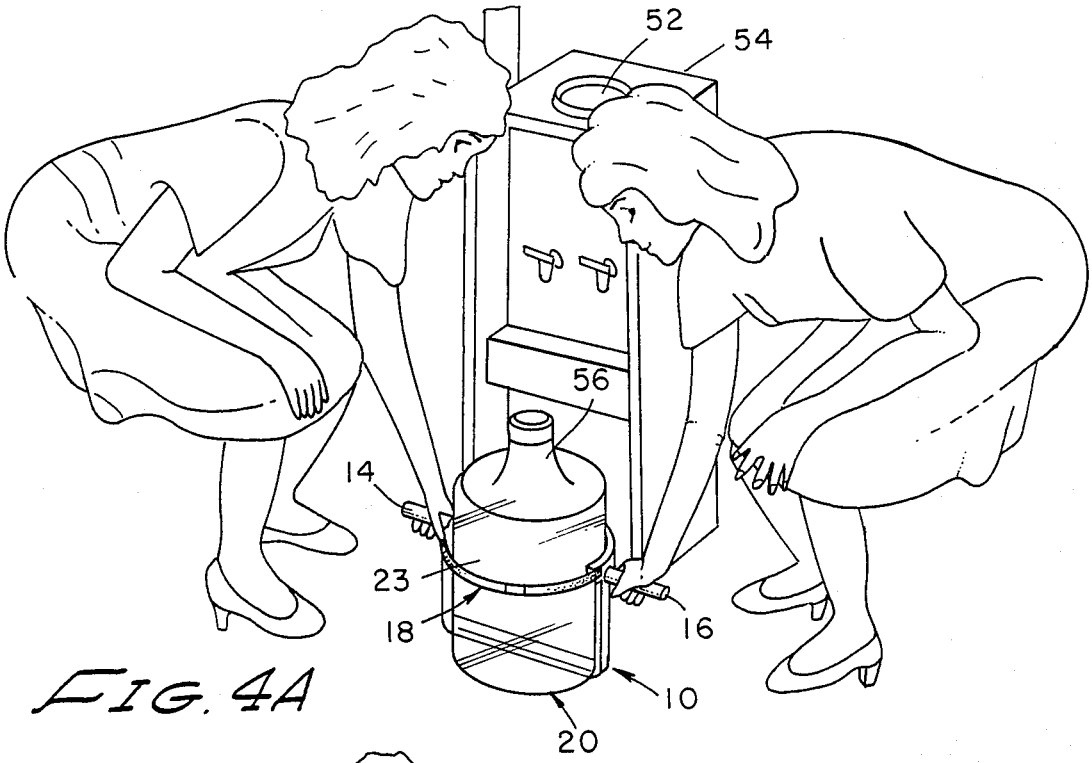
FIGS. 4A and 4B illustrate the use of the device of FIG. 1 in lifting the water bottle for installation in a water dispenser.
Figure 4B:
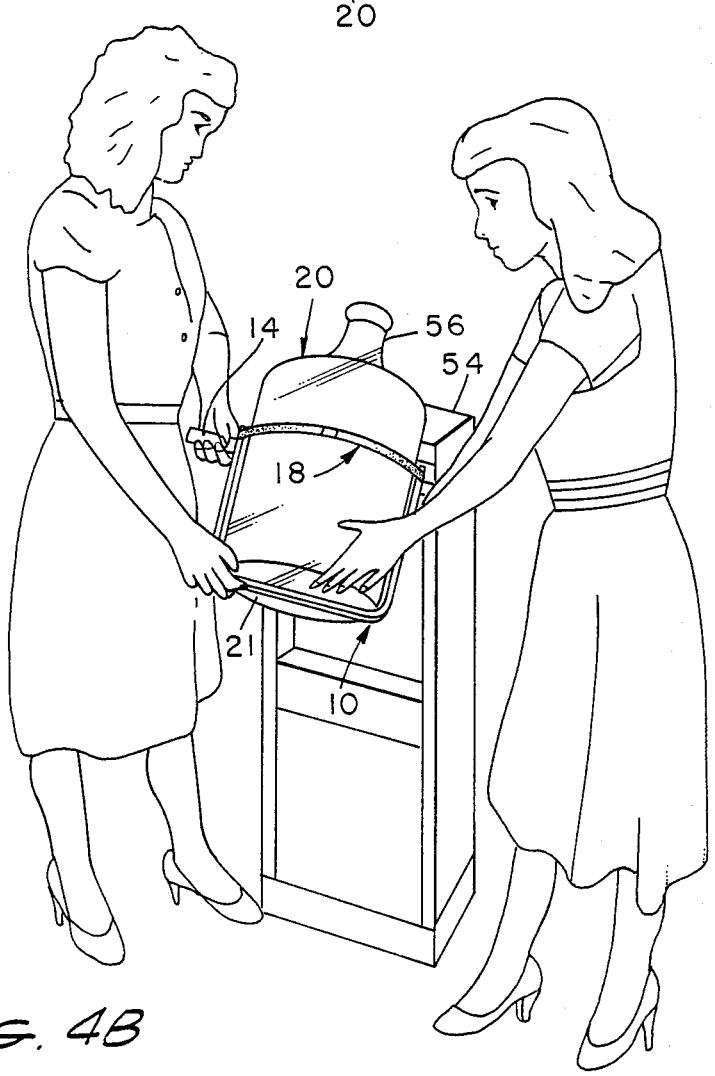

As illustrated in FIG. 4A, two persons easily lift the bottle 20 with the lifting device 10 by gripping the horizontal handles 14 and 16 on either side of the bottle 20 and standing to an upright position (see FIG. 4B). The device 10 can then be inverted for installation in the receptacle 52 of the water dispenser 54 by continuing to grip the horizontal handles 14 and 16 and lifting the bottle 20 with the nongripping hands. The spout 56 of the bottle should be immediately over the receptacle 52 so that the water inside the bottle 20 will gradually pour into the receptacle 52.

Figure 5:
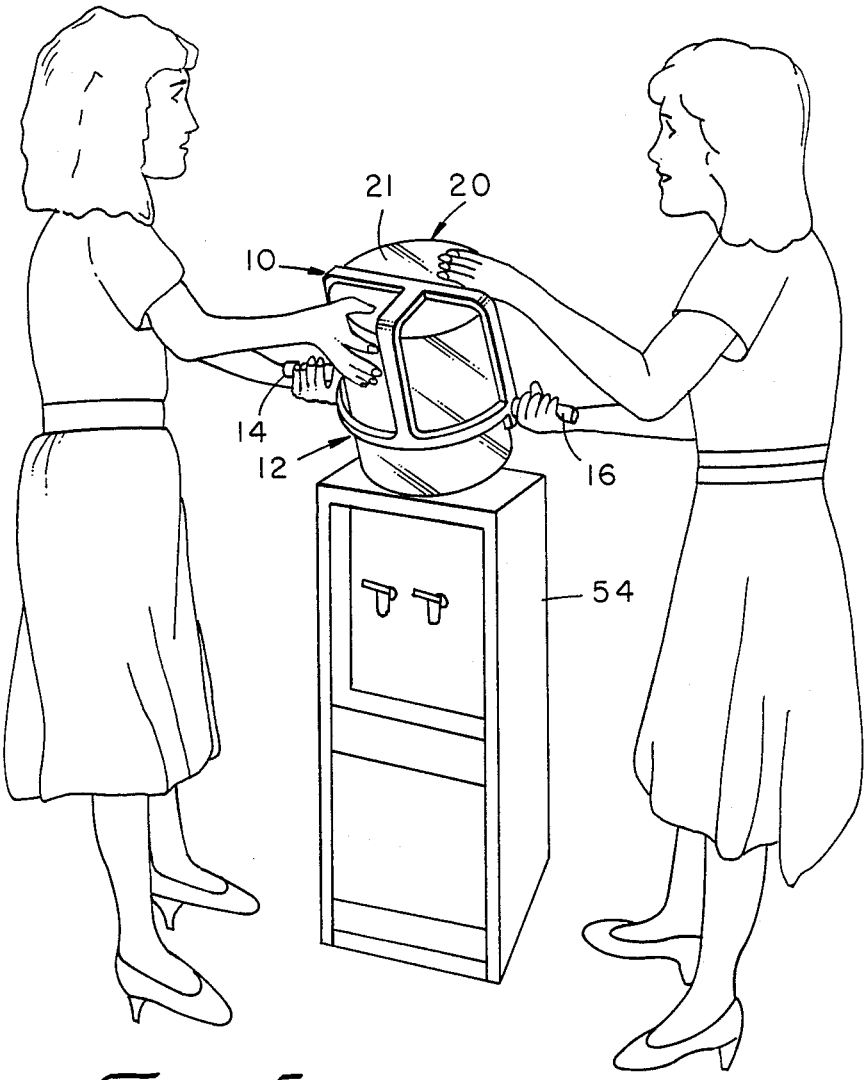
FIG. 5 illustrates the use of the device of FIG. 1 to invert the water bottle and place it into the receptacle of a water dispenser.
Figure 6:
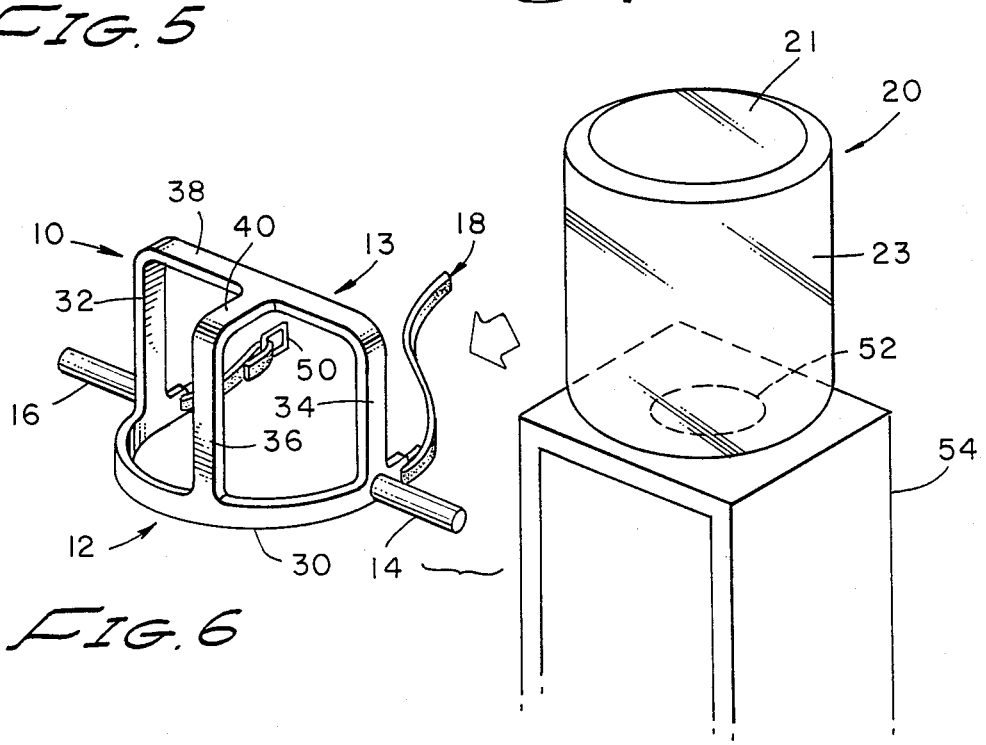
FIG. 6 illustrates the removal of the device of FIG. 1 from the water bottle after it has been installed in the water dispenser.

The operators of the device 10 can easily rotate the bottle into an inverted position and install it in the water dispenser 54, as shown in FIG. 5. Finally, the device 10 can be readily removed from the bottle 20 by loosening the securing means 18 and pulling the device 10 from the bottle 20.

Although preferred embodiments of the present invention have been described in considerable detail, other versions and embodiments of the invention are possible. Therefore, the present invention should not be limited to the preferred embodiments described herein, but instead is defined by the spirit and scope of the appended claims.

What is claimed is:

1. A device for lifting and inverting a substantially cylindrical container comprising:

(a) a rigid support means for supporting the container, the support means forming a substantially semicylindrical cavity of slightly greater internal diameter than that of the container;

(b) means for securing the container inside the rigid support means; and (c) first and second horizontal handles attached to the extending outwardly from opposing edges of the support means, the horizontal handles having longitudinal axes disposed in a substantially straight line which passes through substantially the center of gravity of the container, the longitudinal axes further being disposed so that they are substantially perpendicular to the longitudinal axis of the cylindrical container when the device is in use.

2. The device of claim 1 wherein the rigid support means comprises two oppositely disposed upper corners, and wherein the means for securing the container inside the rigid support means is a belt means, attached to each opposite upper corner of the rigid support means, for wrapping around a portion of the container opposite the rigid support means and for securing the container inside the support means.

3. The device of claim 1 wherein the belt means includes two straps, each having a first end attached to one opposite upper corner of the rigid support means, the belt means having a belt attachment means attached to a second end of each of the straps for securing the straps against the container.

4. A device for lifting and inverting a substantially cylindrical container comprising:

(a) a rigid support means for supporting the container including:

(i) a semi-circular bar;

(ii) first and second opposed vertical bars, each having first ends attached to opposing ends of the semi-circular bar, the opposed vertical bars being at substantially right angles to a plane of semi-circular cross-section of the semi-circular bar, the opposed vertical bars further being of substantially the same length;

(iii) a back vertical bar having a first end attached to substantially a midpoint of the semi-circular bar, the back vertical bar being at a substantially right angle to the plane of semi-circular cross-section of the semi-circular bar, the back vertical bar being of substantially the same length as each of the opposed vertical bars;

(iv) a transverse bottom bar, having opposite ends attahced to second ends of the first and second opposed vertical bars; and (v) a radial bottom bar having a first end attached to substantially a mid-point of the transverse bottom bar and a second end attached to a second end of the back vertical bar, the support means forming a substantially semi-cylindrical cavity of slightly greater dimensions than the surface of a semi-cylindrical bottom portion of the container;

(b) a belt means, attached to the opposing ends of the semi-circular bar, for wrapping around the circumference of the container opposite the rigid support means and for securing the container inside the support means; and (c) first and second horizontal handles attached to and extending outwardly from the first and second opposed vertical bars, the horizontal handles having longitudinal axes in a substantially straight line which passes through substantially the center of gravity of the container, the longitudinal axes further being substantially perpendicular to the longitudinal axis of the cylindrical container.

5. A lifting device for lifting and inverting a container containing a volume of liquid, the container having a horizontal container base and upwardly extending sides, the lifting device comprising:

(a) a rigid support means for supporting the container, the support means comprising a horizontal support means base and upwardly extending support means sides, the support means sides defining a vertically disposed opening adapted to accept the container;

(b) means for securing the container inside the rigid support means; and (c) first and second horizontal handles attached to and extending outwardly from opposing edges of the support means sides, the horizontal handles having longitudinal axes disposed substantially along a straight axis line which is substantially parallel to a horizontal plane disposed a distance L above the horizontal support means base and extending through the container in such a way that equal weights of liquid are disposed above and below the plane, the access line being disposed a distance between about 0.8 L and about 1.2 L above the support means base.

* * * * *

UNITED STATES PATENT AND TRADEMARK OFFICE

CERTIFICATE OF CORRECTION

PATENT NO. : 4,834,438

DATED : May 30, 1989

INVENTOR(S) : Donald A. Haidet

It is certified that error appears in the above-identified patent and that said Letters Patent is hereby corrected as shown below:

Column 1, line 33, "must" should read --most--.
Column 3, line 41, "distant" should read --distance--.
Column 4, line 26, "23" should read --34--.
Column 4, line 66, "mode" should read --made--.
Column 5, line 19, after "be" insert --held--.
Claim 1, line 5, "semicylindrical" should read --semi-cylindrical--.
Claim 1, line 9, "the" should read --and--.
Claim 4, line 21, "attahced" should read --attached--.
Claim 5, line 20, after "container" insert --(when the container is disposed in place upon the lifting device)--.

Signed and Sealed this

Thirteenth Day of February, 1990

*Attest:*

JEFFREY M. SAMUELS

*Attesting Officer* *Acting Commissioner of Patents and Trademarks*